United States Patent [19]

Irving et al.

[11] 4,105,123

[45] Aug. 8, 1978

[54] FRUIT SORTING CIRCUITRY

[75] Inventors: Donald W. Irving, San Jose; Donald W. Chamberlin, Los Gatos, both of Calif.

[73] Assignee: FMC Corporation, San Jose, Calif.

[21] Appl. No.: 707,743

[22] Filed: Jul. 22, 1976

[51] Int. Cl.[2] ..... B07C 5/342

[52] U.S. Cl. ..... 209/111.6; 209/74 M; 250/223 R; 250/226; 356/178

[58] Field of Search ..... 209/111.6, 111.7 R, 209/74 R, 74 M; 356/87, 178, 186, 195; 250/223 R, 226

[56] References Cited

U.S. PATENT DOCUMENTS

| | | | |
|---|---|---|---|
| 3,393,800 | 7/1968 | Durand | 250/223 R X |
| 3,619,061 | 11/1971 | Mitchell | 356/87 X |
| 3,750,883 | 8/1973 | Irving et al. | 209/111.6 |
| 3,980,181 | 9/1976 | Hoover et al. | 209/111.6 |

*Primary Examiner*—Robert B. Reeves
*Assistant Examiner*—Joseph J. Rolla
*Attorney, Agent, or Firm*—R. S. Kelly; C. E. Tripp

[57] ABSTRACT

A circuit for detecting the color of fruit on a plurality of conveyor paths by measuring the light reflected from the surface of the fruit at a viewing station at each path. The circuitry operates to develop a pair of signals at each of the conveyor paths which signals are provided by measurements of the amount of light reflected from the fruit within two distinct bands of wavelengths of light. These signals are routed, one pair at a time, through a pair of amplifiers and a pair of voltage comparators to develop appropriate discharge signals for each of the conveyor paths. A sequencer controls a pair of switching circuits which direct the signals, one at a time, to the amplifiers. The sequencer also directs any signals from the comparators to driver circuits which provide power to divert cull fruit from each conveyor path.

9 Claims, 5 Drawing Figures

FRUIT SORTING CIRCUITRY

BACKGROUND OF THE INVENTION

1. Field of the Invention

The present invention pertains to circuitry for sorting fruit according to the color thereof, and more particularly, it pertains to circuitry for sorting fruit being transported upon a plurality of conveyor paths by separately measuring and comparing the light reflected from the surface of each fruit within two different bands of wavelengths of light.

2. Description of the Prior Art

Colorimetry, i.e., the analysis of objects upon the basis of their color is used in the variety of fruit and vegetable sorting applications. Color sorting circuitry which has been specifically designed for the sorting of fruits or vegetables generally provides some means for measuring the reflectance properties of the fruit or vegetable being tested. The reflectance of a surface is a measure of the percentage of incident light reflected by it, and colored objects have different reflectances for light of different wavelengths. The relationship between reflectance and the illuminating wavelength for a fruit being tested will produce a characteristic curve which can then be used in the design of apparatus and circuitry for color rating that fruit. That is to say, a fruit may be classified as to color by suitably measuring, describing, and classifying its reflectance curve, and fruit may be sorted into different grades by denoting the differences between the reflectance curves for the various grades and testing for these differences.

Some of the prior art systems for measuring the characteristics of fruit or the like include circuitry which measures the reflectance of the fruit in two different bands of wavelengths of light. One of the selected bands will include a wavelength wherein the variation of reflectance between distinct color grades is at a maximum, and the other band may comprise wavelengths wherein there is little or no variation in reflectance between the different grades of fruit. The determination of the color of the fruit can then be measured by observing the difference in the value of the reflectance at the two different bands of wavelengths. In typical prior art systems photodetectors are utilized for converting reflected light in two distinct bands into a pair of electrical signals which are indicative of the amount of light reflected by the fruit within these two different wavelength bands. In one particular prior art system these light reflection signals are amplified and then continuously electronically divided to provide an analog ratio signal which is proportional to the ratio of the light reflection signals which, in turn, corresponds to the relative amount of the characteristic color in the fruit. Voltage comparators are provided for comparing this ratio signal with a plurality of fixed ratio signals representative of the cut points between adjacent color grades, and logic circuitry is connected with such comparators to interrogate the various comparisons so as to obtain a discharge signal in order to direct the fruit being viewed to a particular discharge location in accordance with its determined color grade. Such circuitry is required for each of the conveyors or conveyor paths in the apparatus which carries fruit to the areas where the sorting occurs, and such circuitry is shown in the prior United States patent to Irving et al U.S. Pat. No. 3,750,883. Other prior art color sorting systems use various circuits for directly comparing the two electrical signals from the photodetectors to determine whether or not they exceed a fixed ratio signal or a series of fixed ratio signals.

The aforedescribed circuitry, including the circuitry shown in the aforementioned Irving et al patent, includes amplifiers and ratio circuits, however, which are relatively expensive so that the systems become relatively expensive for a conventional fruit sorting operation where a plurality of conveyors or separate conveyor paths are used.

SUMMARY OF THE INVENTION

The circuitry of the present invention provides a means for using only a single pair of amplifiers and a comparison means for interrogating light reflection signals developed from fruit on a plurality of separate conveyor paths wherein multiple signals from a plurality of fruit are continuously being received. Associated with each of the conveyor paths is an individual detection means which provides a pair of continuous light reflecting signals with the signals indicating the amount of light reflected by a fruit within two different bands of wavelengths of light. Means are provided for sequentially coupling the signals from each of the detection means to the amplifiers which amplify the signals and send them to the comparison means. Means are also provided for sequentially coupling each one of a plurality of driver circuits to the output of the comparison means so that the light reflecting signals from a cull fruit on any of the conveyor paths will provide a signal to a corresponding one of the driver circuits. The driver circuits provide power for diverting such cull fruit from the conveyor path in which it is found.

DESCRIPTION OF THE PREFERRED EMBODIMENT

As pointed out hereinbefore, the circuitry of the present invention is adapted to be utilized in connection with a fruit sorting apparatus wherein individual fruit are conveyed past a viewing area on a plurality of conveyors or in a plurality of conveyor paths. One such sorting apparatus comprises an endless conveyor belt having a plurality of longitudinally extending ridges or raised areas thereon so that fruit, such as tomatoes, that is delivered upon the belt will be caused to orient itself into transversely spaced, single file lanes of fruit. At the viewing area at the discharge end of the belt each fruit is illuminated and the light reflected from the surface of the fruit is received and split into two portions which are each passed through a separate optical filtering means to restrict the wavelengths of light transmitted, such procedure being conventional in fruit color sorting operations as shown, for example, in prior U.S. Pat. No. 3,770,111 to Greenwood et al. Since the fruit will be arranged in a plurality of lanes, obviously separate pairs of optical filtering means must be provided for each fruit discharging lane. The light from the filters is directed to a pair of photodetector means where it is converted into a pair of electrical signals. The signal from each photodetector, the amplitude of which is proportional to the intensity of the light reflected in the band of wavelengths of light passing through the associated filter, is then processed with the circuitry of the present invention to determine whether the fruit is a good fruit or a cull and to provide a discharge signal which diverts any cull fruit into a cull discharge location.

While the circuitry of the present invention may be utilized in sorting fruit or vegetables of any type, such circuitry is particularly adapted to the sorting of tomatoes in a tomato harvesting machine. Consequently, the following description will be specifically directed toward circuitry for sorting tomatoes although it should be understood that the identical circuitry may be used to sort other types of fruits and vegetables with but minor changes in the optical filtering means.

As pointed out previously, the present invention utilizes the prior art method of measuring the reflected light from the surface of the fruit within two distinct bands of wavelengths; for example, one of the bands of light may be in the green area and a second band may be in the red area. The associated green and red filters used to restrict the transmitted light to such bands may have peak responses near 550 and 670 nanometers respectively. The signals from the photodetectors associated with such filters may be referred to as a "green" signal and a "red" signal respectively. It is also possible to use a band in the red area and another band in the near-infrared area; then the associated red and the near-infrared filters may have peak responses near 670 and 980 nanometers respectively.

Figure 1:
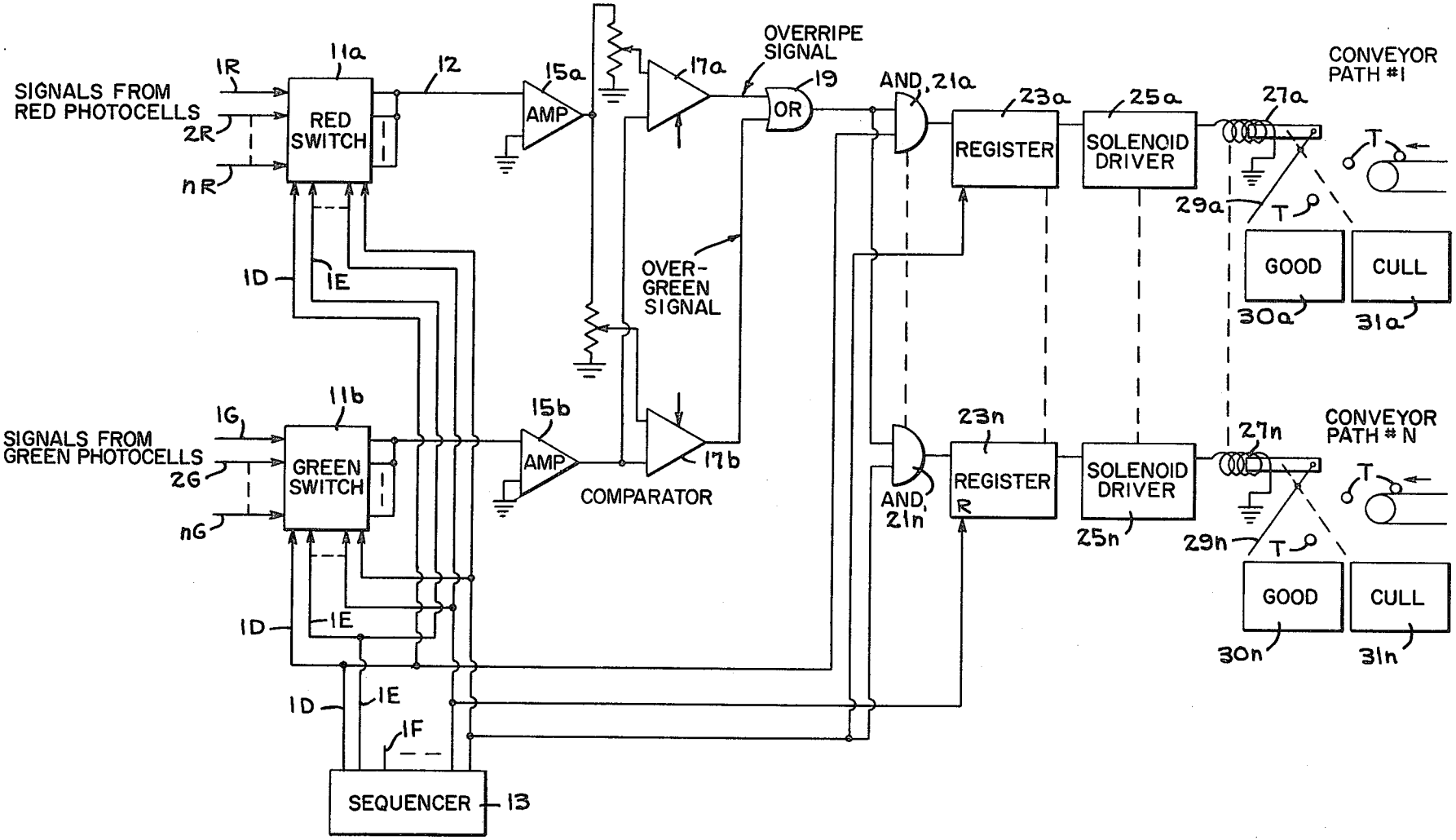
FIG. 1 is a block diagram representation of the circuitry of the present invention.

The circuitry of the present invention is shown schematically in the block diagram illustration of FIG. 1. A pair of electrical signals are received from the pair of photodetectors at each of a plurality of conveyor paths (only two of such conveyor paths, path #1 and path #N being shown) and applied to a pair of electronic switches 11*a* and 11*b*. A "red" signal from each of the conveyor paths is coupled to a corresponding one of the lines 1R, 2R . . . *n*R to the input of the red switch 11*a*, and a "green" signal from each of the conveyor paths is coupled to a corresponding one of the input lines 1G, 2G . . . *n*G to the green switch 11*b*. The switches each have a plurality of pairs of switch contacts with one pair of contacts being connected together when a signal is applied to a corresponding one of the control leads 1D, 1E . . . shown at the bottom of the switches. For example, when a positive signal is applied to the control lead 1D of switch 11*a* input lead 1R is connected to the output lead 12. When a positive signal is applied to the control lead 1E input lead 2R is connected to the output lead 12, etc. One such multi-channel switch 11*a*, 11*b* which may be used with the circuitry of the present invention is the solid state switch DG 506B which is readily available from several electronic component manufacturers.

A sequencer 13 simultaneously applies switching signals to each of the switches 11*a* and 11*b* causing these switches to synchronize the coupling of signals from the conveyor paths to the input of a pair of amplifiers 15*a* and 15*b*. For example, when a "red" input signal from the "red" photodetector on the first conveyor path is coupled through red switch 11*a* to the input of amplifier 15*a*, an input signal from the "green" photodetector on the first conveyor path is coupled through the switch 11*b* to the input lead on amplifier 15*b*. The red and green signals are amplified by amplifiers 15*a* and 15*b* and applied to a pair of ratio detector circuits, or voltage comparators, 17*a* and 17*b*. If an overripe tomato on conveyor path No. 1 causes the amplifier 15*a* to provide a red signal which is greater than the green signal from amplifier 15*b* by a predetermined ratio, the comparator 17*a* provides an overripe output signal to an OR-gate 19. It will be noted that the comparator provides a signal out when the "red" input signal is greater than the "green" input signal, and a potentiometer is provided on the "red" input lead in order to adjust the relative values of the input signals to achieve the desired predetermined ratio for the overripe output signal. The voltage from sequencer 13 also simultaneously enables an AND-gate 21*a* so that the output signal from OR-gate 19 is coupled through gate 21*a* to a register 23*a*. Register 23*a* delays the over-ripe output signal so that the signal from the register is synchronized with the movement of the fruit being scanned at the end of the fruit conveyor. The delayed signal from register 23*a* is coupled to a solenoid driver 25*a* causing the solenoid driver to energize the coil of a solenoid 27*a*. The energized solenoid causes a paddle 29*a* to move into the path of the overripe tomato being discharged from conveyor path No. 1 and deflects the said tomato into a cull container 31*a*. So noted in FIG. 1, a plurality of gates 21, registers 23, solenoid drivers 25, solenoids 27 and paddles 29 are provided—one set for each of the conveyor paths #1 – #N. The paddle, the solenoid and the solenoid driver circuitry are not considered to be part of the present invention but are the subject of a separate U.S. Pat. application of Donald W. Chamberlin et al, Ser. No. 707,744, filed on even date herewith.

In a similar manner when a signal from one of the green photodetectors is greater than the signal from the corresponding red photodetector by a predetermined ratio, the signal coupled through the green switch 11*b* and applied to the comparator 17*b* is greater than the signal coupled through the red switch 11*a* and applied to the comparator. This difference between the green and red signals cause the comparator 17*b* to provide an overgreen signal which is coupled through OR-gate 19 to the inputs of the corresponding AND-gates 21*a*–21*n*. At the same time that these signals are coupled through the red and green switches 11*a* and 11*b* the sequencer output voltage D, E, F, etc. also enables one of the AND-gates 21*a*–21*n* so that an overgreen signal from the comparator circuit is coupled through a corresponding one of the AND-gates 21*a*–21*n* to one of the registers 23*a*–*23n*, such AND-gate and register being associated with the conveyor path of the green fruit from which the said overgreen signal originated. This signal is coupled through the register, amplified by the corresponding solenoid driver and applied to the coil of one of the solenoids 27*a*–27*n* thereby causing one of the paddles 29*a*–29*n* to be moved into the path of the green tomato and to deflect it into one of the reject boxes 31*a*–31*n*.

As seen in FIG. 1 the red signals from the red photodetector at conveyor path No. 1 are available on the input line 1R, the red signals from conveyor path No. 2 are available on line 2R, and the signals from the red photodetector at the nth conveyor path are available on line *n*R. In a similar manner, the signals from the green photodetector at conveyor path No. 1 are available on line 1G, etc. At regular intervals the voltage from the sequencer 13 on line 1D causes the signals from line 1R and 1G to be simultaneously coupled through switches 11*a* and 11*b* to amplifiers 15*a* and 15*b*. Thus, any overripe signal or overgreen signal due to a cull tomato on conveyor path No. 1 will be coupled to the upper input lead of each of the AND-gates 21*a*–21*n*. The voltage from sequencer 13 on line 1D enables the AND-gate 21*a* so that the overripe or overgreen signal originating from conveyor path No. 1 will be coupled through AND-gate 21*a* to register 23*a*. This signal in register 23*a* is delayed slightly and applied to the solenoid driver 25*a* which energizes the solenoid 27*a* and rejects the cull tomato which is moving through the space between the end of conveyor path No. 1 and the good container 30*a* thereby causing the paddle 29*a* to deflect the cull tomato into the reject container 31*a*.

In a similar manner, any tomato on conveyor path No. N provides signals through amplifiers 15*a* and 15*b* to the voltage comparators 17*a* and 17*b*. When the tomato is overripe or overgreen one of the comparators 17*a* or 17*b* develops an output signal which is coupled through AND-gate 21*n* and register 23*n* to solenoid driver 23*n*. Solenoid driver 23*n* provides power to activate solenoid 27*n* thereby deflecting the cull tomato from the end of conveyor path No. N into the reject container 31*n*. The circuitry shown in FIGS. 1 and 2 uses only a single pair of amplifiers and a single pair of voltage comparators to process signals from a plurality of conveyor paths. The circuitry operates to transfer these signals to the proper solenoid to deflect any cull tomatoes which are being transported by any of the plurality of conveyor paths No. 1 through No. N.

Figure 5:
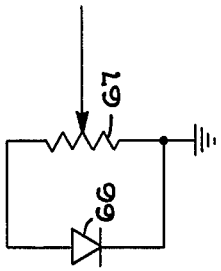
FIG. 5 is a schematic diagram illustrating details of the photodetector circuits of FIG. 2.

Details of the photodetectors 40 and 41 of each of the conveyor paths may be seen in the detail diagram of FIG. 5. Each photodetector includes a photodiode 66, which develops a signal in response to the light input and a potentiometer 67 which may be adjusted to compensate for any differences in light response between different photodiodes. The potentiometers can also be used to aid in adjusting the relative signal outputs of the red and green photodetectors at each of the conveyor paths so that the sorter can be readily adjusted to distinguish between and thereby sort different colors of fruit. For example, when ripe yellow fruit is being conveyed the settings of the potentiometers may be different than when ripe red fruit is being conveyed.

Figure 2:
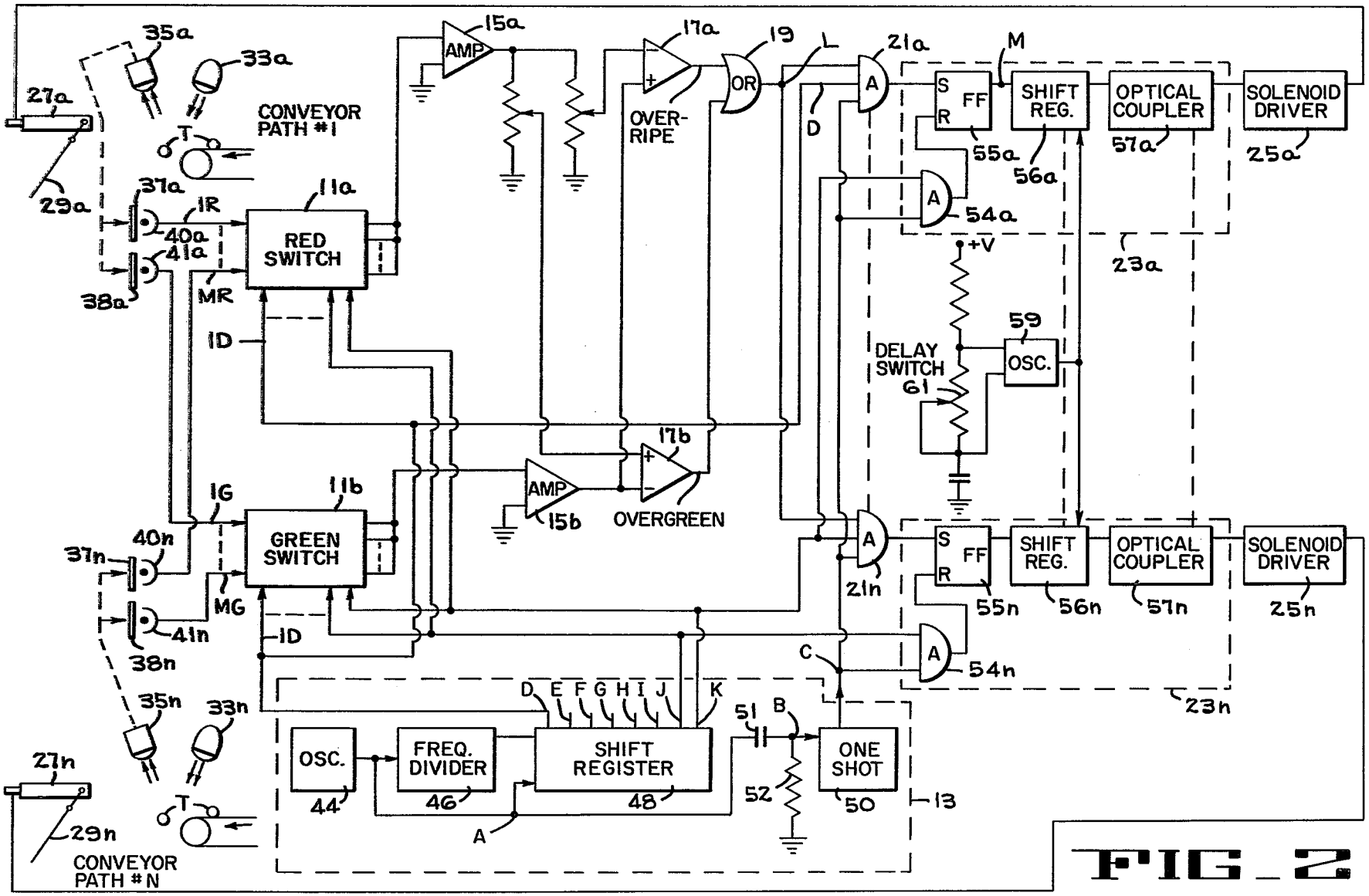
FIG. 2 is a schematic diagram of the circuitry of the present invention and the main functional apparatus components with which such circuitry is associated showing in greater detail than in FIG. 1 the various individual circuit elements.
Figure 3:
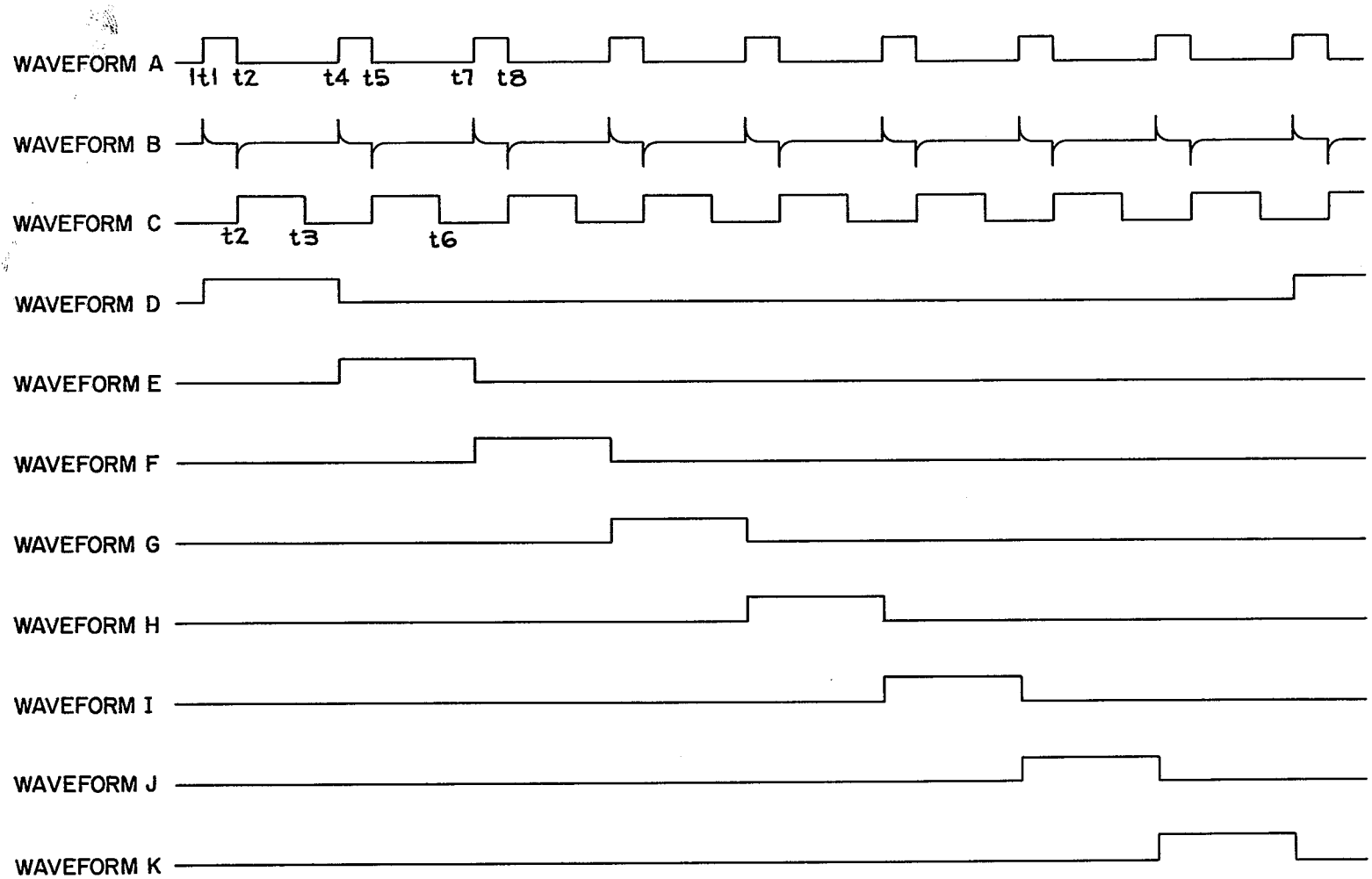
FIGS. 3 and 4 are waveforms which are useful in explaining the operation of the circuitry of the present invention.

Details of the sequencer 13 and its manner of operation may be seen by referring to the diagram of FIG. 2 and the waveforms shown in FIG. 3. An oscillator 44 develops the pulses shown in waveform A of FIG. 3 and applies these pulses to a frequency divider 46 and a shift register 48. The frequency divider 46 divides the pulses by an integral number, such as 8, to produce the low frequency pulses shown in waveform D. The low frequency pulses of waveform D are applied to the signal input lead of the register 48, and the high frequency pulses of waveform A are applied to the trigger input lead of the register. The high frequency pulses cause the wider pulses of waveform D to be shifted through the shift register and to appear sequentially at each of the output leads D-K of the shift register. Thus, the pulse from the shift register first appears at the output lead D, then is shifted to output lead E and sequentially to the other output leads with the voltage being present at only one of the output leads at any one time. The output leads D-K of shift register 48 are connected to the output leads 1D, 1E, etc. of the sequencer 13.

The voltages from the output leads of the register 48, illustrated by waveforms D-K in FIG. 3, cause each of the switches 11*a* and 11*b* to connect the input leads 1R, 1G, etc. one at a time to the output lead of the switch. For example, a positive voltage on the output lead D of the shift register 48 causes the switch 11*a* to connect the input lead 1R of the switch to the output of the switch. At this same time the positive voltage D causes the input lead 1G of switch 11*b* to be connected to the output lead of the switch. Thus, between times *t*1 and *t*4, as shown in FIG. 3, the input lead 1R from the red photodetector 40*a* is connected to amplifier 15*a* and the input lead 1G from green photodetector 41*a* is connected to amplifier 15*b*. At this same time the positive voltage from output lead D of shift register 48 enables the AND-gate 21*a* so that signals from the voltage comparators 17*a* and 17*b* are coupled to the register 23*a* shown in FIGS. 1 and 2. Thus, any signals developed by the photodetectors at conveyor path No. 1 will be coupled through the AND-gate 21*a* to the register 23*a* and provide signals which causes the solenoid driver 25*a* to activate the solenoid 27*a* thereby deflecting any cull tomato that is discharged from conveyor path No. 1.

To synchronize the transferring of signals through the AND-gates 21*a*–21*n* a one-shot circuit 50 is used to provide enabling pulses to the AND-gates 21*a*–21*n*. The one-shot 50 is triggered by the pulses shown in waveform A which are coupled through a capacitor 51 (see waveform B ) to the input lead of the one-shot 50 causing the one-shot to develop an output signal as shown in waveform C of FIG. 3. The signal represented by waveform C causes the information developed by the photodetectors to be gated through gates 21*a*–21*n* during the middle of each of the pulses of waveforms D-K, for example, between times t2 and *t*3 for pulse D. The reading of the information in the mid-period of the time when the switches 11*a* and 11*b* are closed provides greater reliability because the level of the signal being transferred through the switches reaches a stable value during the mid-period of the time when the switches are closed.

Details of the registers of 23*a* and 23*n* of FIG. 1 are shown in FIG. 2. Each of the registers 23*a*–23*n* will be seen to include an AND-gate 54, flip-flop 55, a shift register 56 and an optical coupler 57. Signals from each of the AND-gates 54 are coupled to the set input of a corresponding one of the flip-flops 55 thereby causing the information from the photodetectors to be stored in the flip-flop 55. The signal from flip-flop 55 is coupled to the corresponding shift register 56 which delays the transmission of the signal to compensate for varying speeds of the tomatoes on the conveyor paths. For example, if the conveyor is moving fast the tomato moves rapidly through the space between the conveyor and the storage containers 30, 31. When the tomato moves rapidly through space it is necessary to have a short delay between the setting of the corresponding flip-flop 55 and energizing of the solenoid 27 to reject the tomato being sorted. On the other hand, if the conveyor and the tomatoes thereon are moving slowly there is need for more delay between time the information is obtained from the tomato and the time that the tomato is deflected. When a conveyor is moving slower additional time delay in shifting the information through the shift register 56 is obtained by adjusting a delay control potentiometer 61 connected to an oscillator 59. Control potentiometer 61 sets the input voltage to the oscillator 59 to vary the frequency of pulses developed by the oscillator 59 in a known manner. The frequency of the oscillator pulses determines the speed of shifting information through the shift register. The higher the frequency of the pulses the faster the information is shifted through each of the registers 56*a*–56*n*.

Figure 4:
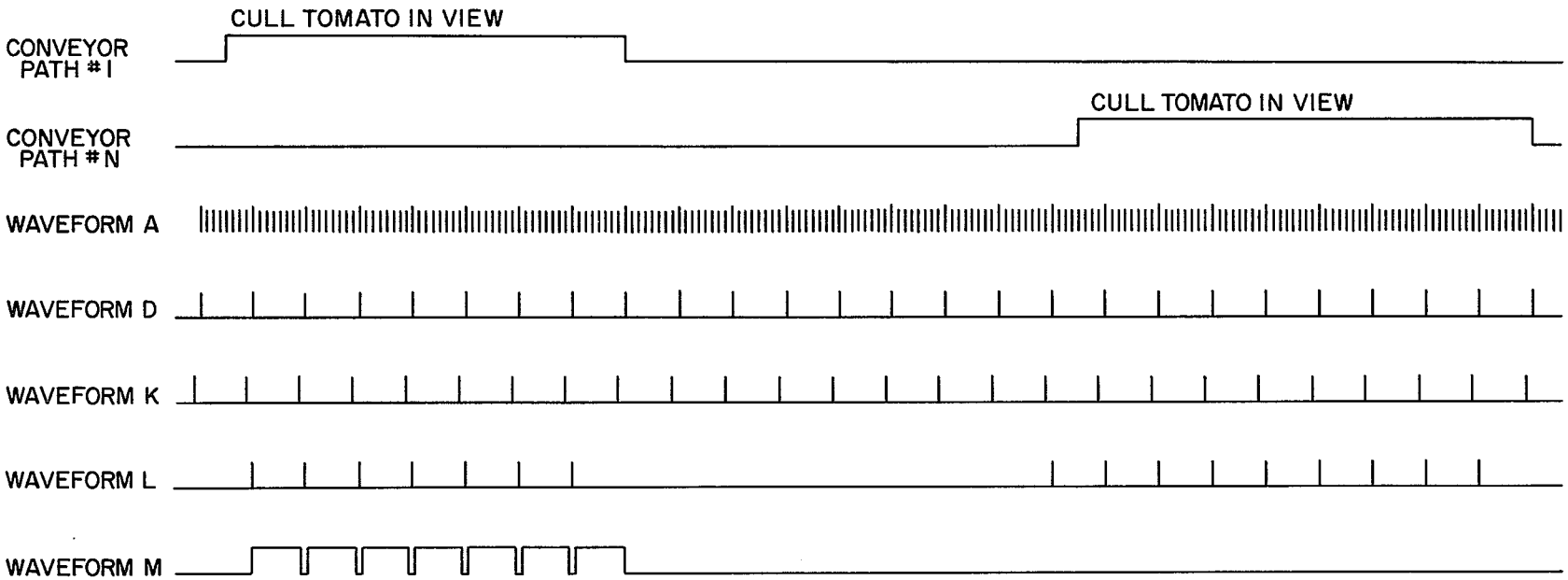

More details of the operation of the circuit of FIG. 2 can be seen by referring to the waveforms of FIG. 4. For example, when a tomato is discharged from conveyor path No. 1 the light from the illuminating lamp 33*a* (FIG. 2) will be reflected from the tomato through a light collecting means 35*a* to a pair of optical filters 37*a* and 38*a*. The optical filter 37*a* may be a red filter and the filter 38*a* may be a green filter. The light going through the filters 37*a* and 38*a* impinges upon a pair of photodetectors 40*a* and 41*a*. When the tomato is green, the value of the signal developed by the green photodetector 41*a* is larger than the value of signal developed by red photodetector 40*a*. The large value of the green signal from input lead 1G is coupled through switch 11*b* during the time *t*1 to *t*4 (FIG. 3) when the positive voltage from the sequencer 13 is applied to the control lead 1D of the switch 11*b*. This signal from 11*b* is amplified by amplifier 15*b* and applied to one of the input leads of the comparator 17*b*. Since a smaller value of red signal is coupled from lead 1R through switch 11*a* and through amplifier 15*a* the comparator 17*b* develops an overgreen output signal. The overgreen signal is coupled through OR-gate 19 and through AND-gate 21*a* to the set input lead of flip-flop 55*a*. The signal sets the flip-flop 55*a* causing the flip-flop to develop a positive voltage at the output lead thereof as shown in waveform M of FIG. 4.

The positive voltage at the output leads of shift register 48 sequentially move from output lead D, to E, and to K as shown in waveforms D-K of FIG. 3. At the time the positive output voltage is developed at output lead K, the AND-gate 54*a* will be enabled by said voltage on output lead K so that the flip-flop 55*a* will be reset. This flip-flop 55*a* is therefore reset at the end of each sequence of switching pulses D-K so any change in input signal from one sequence to the next can be reflected by the setting of flip-flop 55*a*. However, if the green tomato is still in view the flip-flop 55*a* will be again set by the input signal from AND-gate 21*a* to provide a positive output signal so that an almost-continuous positive signal is developed at the output lead of flip-flop 55a as shown in waveform M of FIG. 4. This positive signal is shifted through the shift register 56*a* and applied to the input lead of the optical coupler 57*a* causing coupler 57*a* to develop an output signal. The signal from the optical coupler is coupled to the solenoid driver 25*a* which energizes the solenoid 27*a* causing the paddle 29*a* to deflect the green tomato into the reject container 31*a* as shown in FIG. 1.

An overripe tomato on conveyor path No. 1 would cause a larger signal to be coupled through the switch 11*a* and to provide an overripe signal at the input of OR-gate 19. From this point on, the overripe signals are similar to and indistinguishable from the signals developed by a green tomato. Thus, the output waveform L from gate 19 is the same whether the tomato to be rejected is overripe or overgreen. In either case these signals cause the paddle 29*a* to be moved into the path of the overripe or overgreen tomato to deflect it into the reject or cull, container 31*a*.

A green or overripe tomato on any one of the conveyor paths, for example conveyor path N, would similarly cause a signal to be generated from the OR-gate 19. This signal would then be coupled through gate 21*n*, flip-flop 55*n*, shift register 56*n*, optical coupler 57*n* and solenoid driver 25*n* to activate the solenoid 27*n* and cause the paddle 29*n* to deflect the cull tomato into the corresponding reject container 31*n* as shown in FIG. 1. The sequencer 13 of FIGS. 1 and 2 cycles at a high frequency so that each cull tomato produces several reject pulses as shown in waveform M.

While the waveforms of FIG. 4 shows a cull tomato being discharged from only one conveyor path at any one time, it should be understood that cull tomatoes can be detected and deflected from a plurality of conveyor paths simultaneously. For example, if cull tomatoes were simultaneously discharged from two different conveyor paths waveform L would show twice as many pulses as shown in FIG. 4 during the time the two cull tomatoes were in view. The additional pulses would be positioned between the individual pulses shown in waveform L. The pulses now shown in waveform L would still produce the waveform M shown and would reject the cull tomato on conveyor path No. 1. The additional pulses of waveform L would produce a signal to reject a cull tomato on another conveyor path.

From the foregoing description it can be seen that the present invention provides an inexpensive circuit for routing a plurality of color sorting signals through a pair of amplifiers and a pair of voltage comparators. These color sorting signals are each directed to a corresponding one of a plurality of fruit rejecting means. Thus, only two amplifiers and two voltage comparators are needed to provide reject signals for fruit being discharged from a plurality of fruit conveyors or fruit conveyor paths. The cost of this circuitry is considerably less than for prior art sorting circuitry where multiple conveyors or conveyor paths were used.

Although the best mode contemplated for carrying out the present invention has been herein shown and described, it will be apparent that modification and variation may be made without departing from what is regarded to be the subject matter of the invention.

What is claimed is:

1. In a fruit sorter having a plurality of paths over which fruit may be moved, circuitry comprising:

detection means for producing a pair of continuous light reflecting signals for each of said paths, said signals being determined by the light reflected by a fruit moving in a path and being indicative of the amount of light reflected within two different bands of wavelengths of light;

a comparison means having an output and first and second inputs, said comparison means producing a reject output signal in accordance with the relative values of the signals at said inputs;

first and second electronic switches sequentially coupling said pairs of light reflecting signals one each to said first and second inputs respectively of said comparison means;

a plurality of means for providing a discharge signal in response to a reject output signal, each of said means for providing a discharge signal corresponding to one of said paths over which fruit may be moved;

a plurality of shift registers sequentially connecting said output of said comparison means to each of said means for providing a discharge signal, and a sequencing circuit simultaneously applying a sequence of switching signals to said first and second electronic switches and enabling said plurality of shift registers in sequence so that each of said pairs of light reflecting signals determines the discharge signal for the corresponding one of said paths.

2. In a fruit sorter as set forth in claim 1 wherein said comparison means includes means for generating a reject output signal when a fruit is overgreen.

3. In a fruit sorter as set forth in claim 1 wherein said comparison means includes means for generating a reject output signal when a fruit is overripe.

4. In a fruit sorter as set forth in claim 1 including means for delaying each of said discharge signals until such time as said fruit is in position to be directed to a discharge location.

5. In a fruit sorter as set forth in claim 1 wherein said comparison means includes a pair of comparators for generating a reject output signal when a fruit is overripe and when it is overgreen.

6. In a fruit sorter having a plurality of conveyor paths for carrying fruit to be sorted, circuitry somprising:

detection means for producing a pair of continuous light reflecting signals for each of said conveyor paths, said signals being determined by the light reflected by a fruit moving on a conveyor path and being indicative of the amount of light reflected within two different bands of wavelengths of light;

a pair of amplifiers each having an input and an output;

electronic means for sequentially coupling a first of said pair of light reflecting signals from said detection means at each of said conveyor paths to the input of a first of said amplifiers and providing a first amplifier output signal;

electronic means for sequentially coupling a second of said pair of light reflecting signals from said detection means at each of said conveyor paths to the input of a second of said amplifiers and providing a second amplifier output signal;

comparison means coupled to said first and second amplifier outputs for producing a reject signal when the value of either said first or second amplifier output signal exceeds the value of said second or first amplifier output signal respectively by a predetermined ratio;

a plurality of driver circuits each providing power to divert a fruit from a corresponding one of said conveyor paths upon receiving a reject signal; and means for sequentially enabling each of said electronic means and for sequentially coupling said driver circuits and said comparison means whereby said pairs of light reflecting signals are coupled to said comparison means in synchronism with the coupling of ones of said reject signals to corresponding ones of said driver circuits.

7. In a fruit sorter as set forth in claim 6 including:

delay means connected between said driver circuits and said comparison means, said delay means providing a predetermined time delay between the producing of said reject signal and the receiving of said reject signal by said driver circuit.

8. In a fruit sorter having a plurality of conveyor paths for carrying fruit to be sorted, a circuit comprising:

means for detecting light reflected by fruit moving along the conveyor paths providing first and second continuous light reflecting signals for each conveyor path corresponding to the amount of light reflected therefrom within two different light wavelength bands, first and second amplifiers each haviing an input and providing first and second outputs respectively, means for coupling said first and second continuous light reflecting signals from each conveyor path in sequence to said first and second amplifier inputs respectively at a predetermined frequency, means for comparing said first and second amplifier outputs and providing an output signal including a reject signal when either of the ratios of said first or second outputs to said second or first outputs respectively exceeds a predetermined ratio, and a plurality of driver circuits one for each conveyor path providing power to divert a fruit from a respective one of the conveyor paths responsive to said reject signal, said means for coupling further operating to couple the output signals from said means for comparing to ones of said plurality of driver circuits in sequence at said predetermined frequency.

9. In a fruit sorter as set forth in claim 8, including means for delaying said reject signal connected between said means for comparing and each of said plurality of driver circuits, whereby a predetermined time delay is provided between reception of said reject signal by ones of said driver circuits and the provision of power therefrom to divert a fruit from a conveyor path.

* * * * *